United States Patent [19]

Raymond et al.

[11] 4,376,382

[45] Mar. 15, 1983

[54] RESETTABLE LOCK ASSEMBLY

[75] Inventors: James W. Raymond, 104 Via Lido Soud, Newport Beach, Calif. 92663; James A. Millett, Costa Mesa, Calif.

[73] Assignee: James W. Raymond, Costa Mesa, Calif.

[21] Appl. No.: 211,729

[22] Filed: Dec. 1, 1980

[51] Int. Cl.[3] ..... E05B 25/00; E05B 29/04; E05B 35/08; E05B 35/10

[52] U.S. Cl. ..... 70/338; 70/340; 70/343; 70/383; 70/384; 70/364 R; 70/377

[58] Field of Search ..... 70/384, 383, 382, 364 R, 70/337, 338, 340, 341, 342, 343, 377, 376

[56] References Cited

U.S. PATENT DOCUMENTS

| | | | |
|---|---|---|---|
| 3,990,282 | 11/1976 | Sorum | 70/364 R |
| 3,999,413 | 12/1976 | Raymond | 70/364 R |
| 4,069,694 | 1/1978 | Raymond | 70/337 |
| 4,320,639 | 3/1982 | Kleefeldt | 70/364 R |

*Primary Examiner*—Robert L. Wolfe
*Attorney, Agent, or Firm*—Keith D. Beecher

[57] ABSTRACT

A resettable single-barrel single-plug cylindrical two section lock assembly is provided wherever master keying is required. The lock of the invention is intended to be operated and reset by three different keys. One key (#1 key) is used to turn the lock to a position in which it may be reset by either of the other two keys. One of the other two keys (#2 key) operates a first section of the dual lock; and the other of the other of the two keys (#3 key) operates a second section of the lock which is independent of the first section. Either section may be reset by inserting the existing #2 or #3 key into the lock once the lock has been turned by the (#1) key to a predetermined position, and then turning the lock to the reset position, and after the existing key has been withdrawn, turning the lock back to its normal operating position by the new key, either the #2 or #3 keys, depending upon which section of the lock is being rekeyed.

5 Claims, 8 Drawing Figures

ACTIVE TUMBLERS

INACTIVE TUMBLERS

RESETTABLE LOCK ASSEMBLY

BACKGROUND

It will become evident as the description proceeds that the lock of the invention has general utility for use in hotels and motels, as well as, for example, in institutions, industrial plants, governmental facilities, and similar places where changes in the locks are required with some frequency, and where master keying is employed. The lock of the invention is functionally similar to the double-plug double-barrel lock described in U.S. Pat. No. 4,069,694 which issued Jan. 24, 1978 in the names of the present inventors. However, the lock of the invention accomplishes the results of the lock disclosed in the patent with a simpler dual-lock mechanism which is contained entirely within a single plug and barrel.

As mentioned above, two separate and independent locking mechanisms are contained within a single barrel and plug in the lock of the invention. The first locking mechanism is controlled by the #3 key, and the second independent locking mechanism is controlled by the #2 key. In each instance, the #1 key is used to enable the two independent locking mechanisms to be turned to their reset positions by the #2 key or the #3 key, which then permits a new #3 key to be inserted to reset the first locking mechanism to accept only the new #3 key; or a new #2 key to be inserted to reset the second locking mechanism to accept only the new #2 key.

As discussed in the patent, problems have arisen during recent years in preventing theft from hotel and motel rooms due to the unauthorized use of the keys issued to the guests and maids. Such keys are often lost, stolen, or otherwise find their way into the hand of thieves. The problem is aggravated because the prior art hotel keys normally carry identifying tags which gives the thief the exact information as to the name of the hotel, its address, and the room number to which access may be gained by use of the particular key.

A principal object of the present invention is to provide a lock assembly which is constructed to be mounted in existing doors in the place of the previous locks, and which provides a simple and relatively simple mechanism which may be readily reset after each occupancy, so that the previous guest key no longer fits the lock and so that the lock may be quickly set to accept a new guest key. Also, the lock of the invention may be readily reset from time-to-time so that the present maid's key no longer fits the lock, and so that the lock may be set to accept a new maid's key.

The lock to be described is a dual-lock, single-plug type, and it is constructed so that one key may be issued to each guest (#3 key), and a different key may be issued to the maid (#2 key), and so that the maid's key and the guest's key may be used to operate the lock independently of one another, and may be differently coded. Precautions are built into the lock to prevent the guest or maid from resetting the lock, this being achieved by the requirement for the program key (#1 key), which must first be inserted into the lock to turn the plug to a position at which it may be turned to its reset position by either the #2 key or the #3 key to enable the lock to be reset either to accept a new #3 key, or to accept a new #2 key and #1 key. In each instance, the #1 key and the #2 key have the same code, except that the #1 key is shorter than the #2 and #3 keys, so that the #1 key alone can turn the plug in a counterclockwise direction to a particular angular position at which the plug may be turned by either of the other two keys to its reset position.

A feature of the dual lock locking mechanism to be described is the provision of a simple assembly which may be reset at will to receive a different #3 key, or to receive a different #1 and #2 key, this being achieved without the need for any special tools, and merely by turning the lock counterclockwise first by the current #1 key, and then by turning the lock by either the #3 key, or by the #2 key, to the reset position, withdrawing the current key, inserting a new #3 or #2 key, and turning the lock back to its original position by the new key. The lock is thereby set so that it cannot be unlocked by the previous key, but can be unlocked only by the new key. The foregoing operations apply to each section of the dual lock independently of one another.

A feature of the lock of the present invention is that it can be made economically on a mass production basis, as compared with the usual prior art locks. This is because each lock of the present invention can be made exactly the same as all others, and each individual lock need not be designed to accept any one particular key. Moreover, the purchaser of the lock of the invention may change the lock to accept a new key at any time, without the need for any extraneous tools. However, the resetting operation cannot be achieved in the case of a hotel, for example, by the guest himself, or by the maid, since only a person having access to the #1 key is able to reset the lock. Also, as described, the dual lock of the invention has an advantage in that it can be constructed to have approximately the same size as the prior art locks, so that it can be easily mounted into existing door hardware to replace existing locks, without the need for costly adaptation operations.

DETAILED DESCRIPTION OF THE ILLUSTRATED EMBODIMENT

The lock of the invention, as described above, includes a barrel 10 (FIG. 7) of a cylindrical configuration, and of an outer diameter which permits the lock to be inserted into existing door hardware so that the lock of the invention may be used to replace existing locks. A plug 12 (FIG. 7) is rotatably mounted within the barrel 10, and it includes an end portion 12A (FIG. 1) which protrudes from the forward end of plug 12 and into a central aperture in a stationary end plate 14 which is mounted in the knob 16 of the door to be controlled by the lock. The portion 12A of the plug 12 has a key slot, as shown in FIG. 1, and a key may be accepted into the key slot, or removed from the key slot, when the portion 12A is aligned with a notch A in the end plate 14 (FIG. 1), or is turned to be aligned with either notch B or notch C.

As explained above, the lock of the invention may be operated by three keys. These keys are designated #1, #2 and #3 in FIG. 4. Keys #1 and #2 have the same code, whereas key #3 has a separate independent code. As mentioned above, key #2 may be issued to the maid, and key #3 may be issued to the guest, when the lock is used in a hotel. Key #1 is retained by an appropriate person who has the responsibility of resetting the locks. Key #2 and key #3 may be used independently to unlock the door by using the keys to turn plug 12 in a clockwise direction in the view of FIG. 1.

Figure 1:
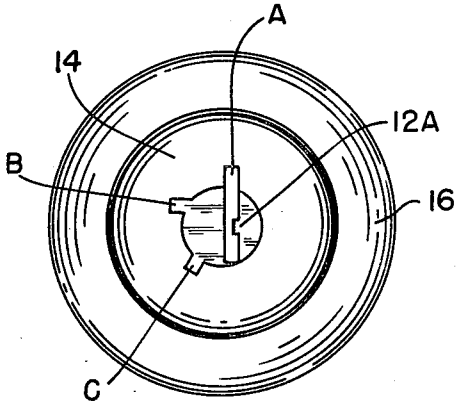
FIG. 1 is a front view of a lock which may be constructed in accordance with the present invention, and installed in the knob of a door to replace the usual knob lock.

Key #1 is the only key that can turn plug 12 in a counterclockwise direction with reference to the view of FIG. 1 from position A to position B. This is because key #1 is shorter than key #2 or key #3. For resetting the first section of the lock, key #1 is used to turn the plug counterclockwise to position B, at which position key #1 is withdrawn, and replaced by current key #3. Key #3 can now be used to turn the plug counterclockwise to position C, at which position current key #3 can be withdrawn through notch C and a new key #3 may be inserted to reset the lock to accept the new key #3. The new key #3 can now be used to turn the lock clockwise back to position B. The new key #3 can now be withdrawn through notch B and can be used in the future to turn the lock clockwise to unlock the door. The #1 key must then be used to return the plug to position A.

As an independent resetting operation for the second section of the lock, current key #1 can be used to turn the lock counterclockwise directly to the reset position C, and current key #1 may be withdrawn and replaced by a new key #1, which can then be used to turn the lock clockwise back to the A position. Then, the new key #1 and key #2 can be used to operate the second section of the lock. It is to be noted that if the lock is changed to accept a new #1 key, it automatically is changed to accept a new #2 key.

Figure 5:
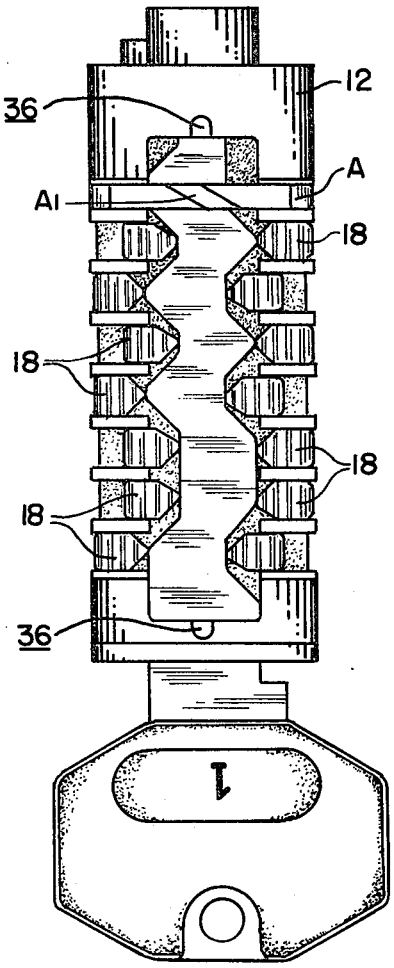
FIG. 5 is a further view of the lock barrel, with certain of its operating components removed for purposes of clarity, and with the #1 key inserted into the lock.

As best shown in FIG. 5, a plurality of tumbler follower members 18 are slidably mounted in the plug, in spaced relationship with one another along the length of the plug, and adapted to move freely in a transverse direction with respect to the axis of the plug. Then, when a key, such as key #1 is inserted into the lock, the followers 18 are caused to move by the code on the key, and to assume different transverse positions, as shown in FIG. 5, and as dictated by the code on the key.

Figure 6:
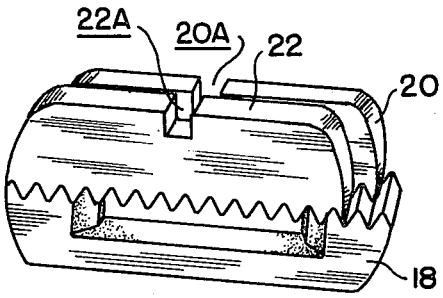
FIG. 6 is a perspective view of the two of the tumblers which are incorporated into the lock assembly mounted on one of the followers, which are also included in the lock assembly.

As shown in FIG. 6, each follower member 18 has a C-shape, and has a serrated surface. Two wafer tumblers designated 20 and 22 are mounted side-by-side on each of the followers 18, and each tumbler has a serrated surface which engages the serrations on the corresponding follower 18. Tumbler 20 has a central slot 20A in its rear edge, and tumbler 22 has a central slot 22A in its rear edge. As will be described, each of the tumblers 22 may be moved to assume a particular relationship with its follower 18 when the lock is set to accept a particular #3 key, and each of the tumblers 20 may be moved to assume a particular relationship with respect to its follower 18, when the lock is set to accept a particular #1 and #2 key. The relationship between the tumblers and their associated followers is not unlike that of the mechanism shown in U.S. Pat. No. 4,069,694 referred to above. The difference being that in the present mechanism, each follower 18 has two separate tumblers 20, 22 associated with it, the two separate tumblers being individually moved to different positions on the corresponding follower when the lock is set and reset.

Figure 2:
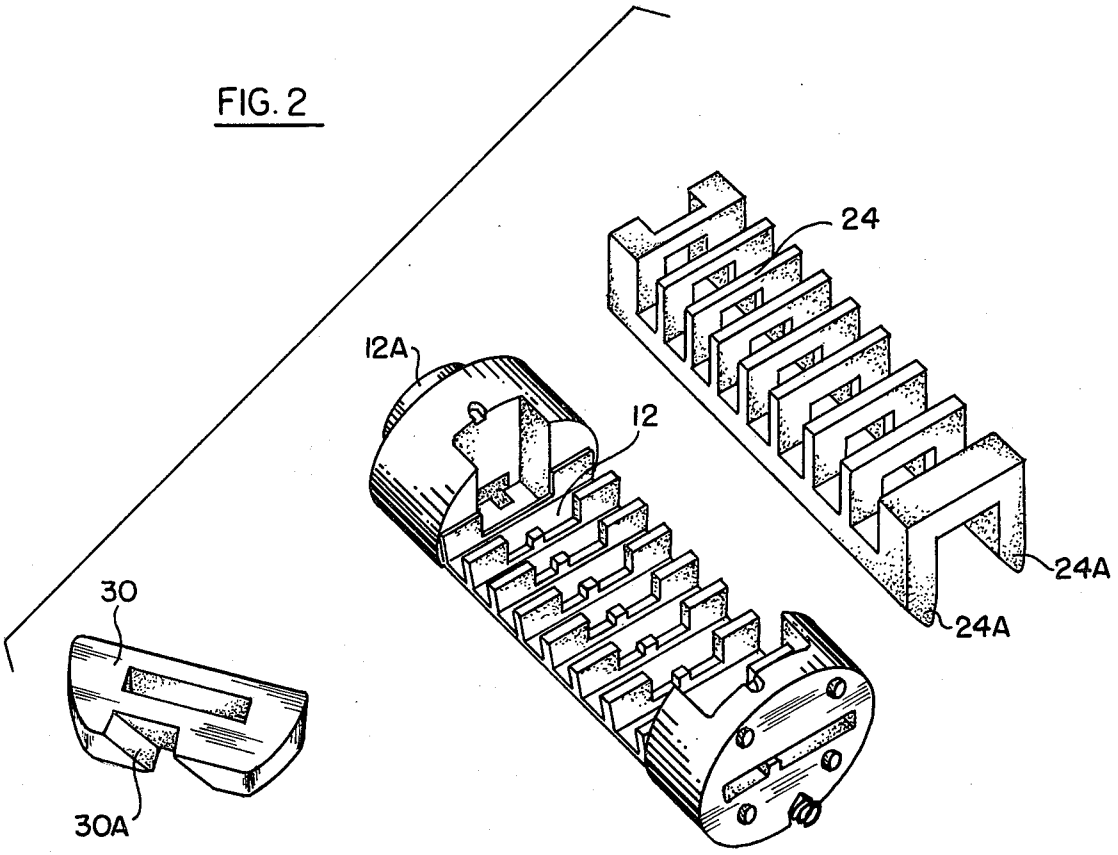
FIG. 2 is an exploded perspective view of the lock of FIG. 1, showing the plug of the lock, and certain of its components.
Figure 3:
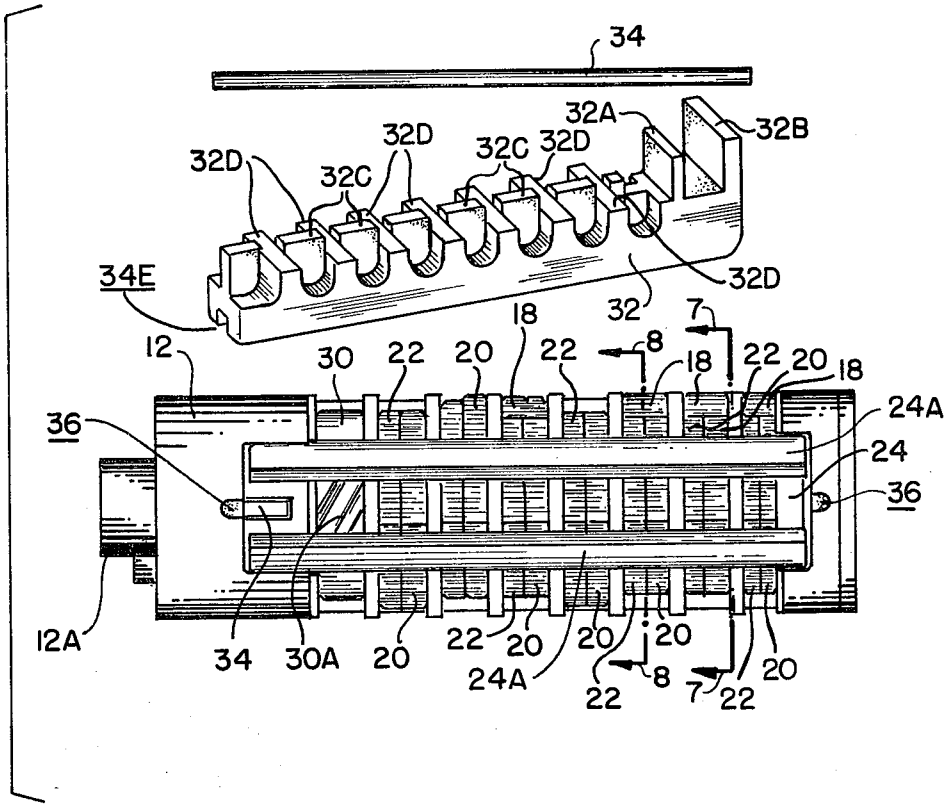
FIG. 3 is a second perspective view showing the plug, and also showing its associated operating components, with certain of the components being removed from the assembly for purposes of clarity.
Figure 7:
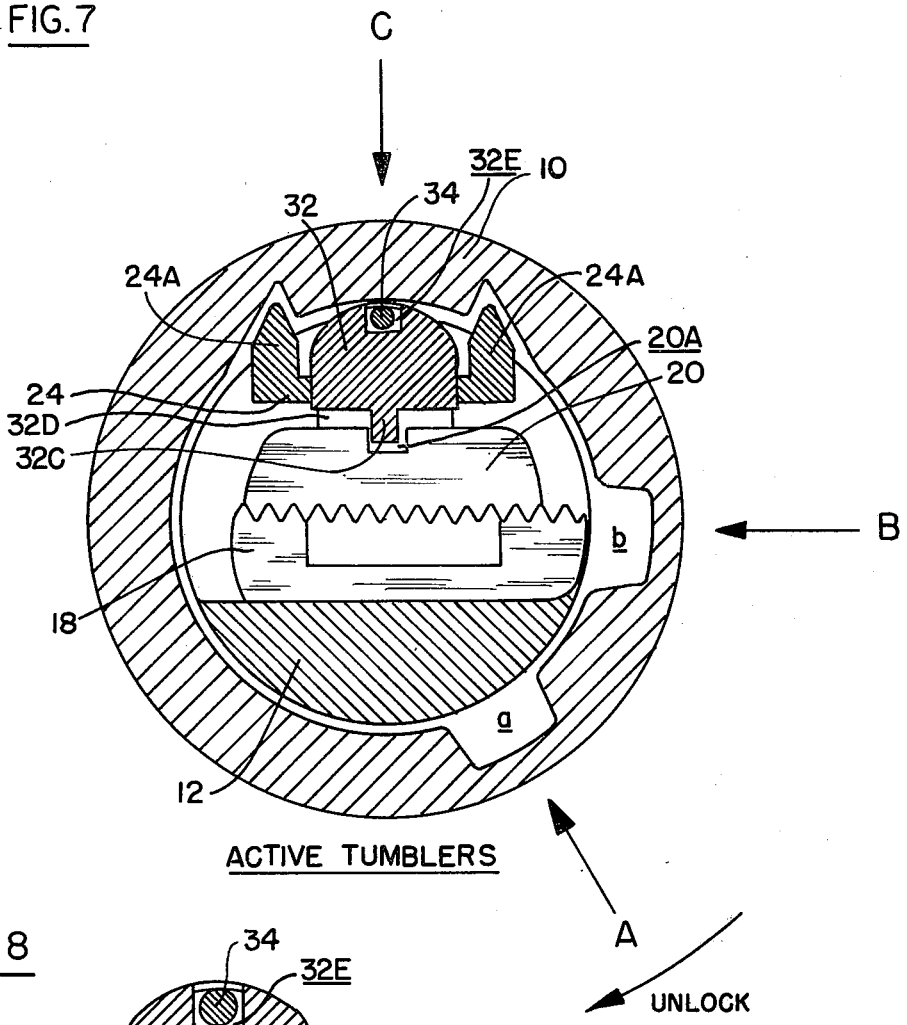
FIGS. 7 and 8 are cross-sections of the lock assembly taken along the lines 7—7 and 8—8 respectively of of FIG. 3 to reveal the operation of the various components of the lock.

The tumblers 20 and 22 and the followers 18 are retained within the plug 12 by a retainer bar 24 (FIGS. 2, 3 and 7). A shifter tumbler 30 (FIG. 2) is also supported on plug 12 at one end of the plug (FIG. 3). A locking bar 32 (FIGS. 2, 3 and 7) is mounted on the plug adjacent to the retainer 24, and it is biased inwardly from the bore of barrel 10 by a bowed resilient rod 34 FIGS. 3, 7 and 8 which is received in a channel 32E in the bottom of the locking bar and in notches 36 at each end of the plug. The central portion of the channel 32E is covered to form a tunnel through which the rod extends. In FIG. 3, the locking bar is inverted, and turned end for end, and then fitted over the assembly shown in the lower portion of FIG. 3.

Figure 4:
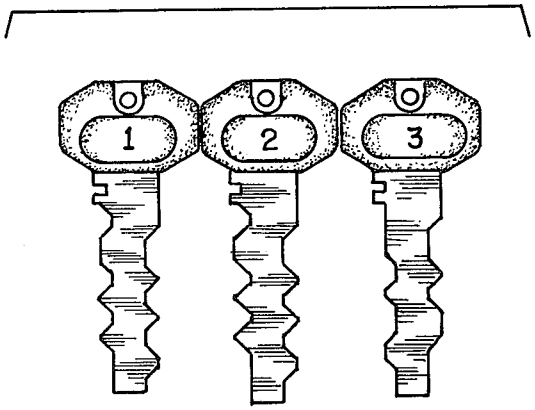
FIG. 4 is a view of the three keys which are used in conjunction with the lock of the invention, the keys being designated respectively #1, #2 and #3.

The locking bar 32 has a transverse projection 32A (FIG. 3) which engages a cam surface 30A on tumbler 30, and it has transverse projections 32D (FIGS. 3 and 7) which extend over the tumblers 20, 22. When the keys of FIG. 4 are inserted into the lock, tumbler 30 is moved in a radial direction towards the bottom FIG. 3, for example, by the end bit on keys #1 or #2, and it is moved radially towards the top of FIG. 3 by the end bit on key #3 in FIG. 4. As the tumbler 30 is moved towards the bottom of FIG. 3 by key #1 or #2, it engages projection 32A and cams the locking bar 32 axially towards left end of plug 30 in FIG. 3 so that the axial sections 32C of the locking bar engage the corresponding slots 22A (FIG. 6) of tumblers 22, thereby locking tumblers 22 and freeing tumblers 20; and when the #3 key is inserted into the lock, its end bit moves the tumbler 30 radially in the opposite direction to cam the locking bar 32 axially towards the other end of the plug 30 so that its axial sections engage 32C the corresponding slots 20A (FIG. 6) of the tumblers 20 to lock tumblers 20 and free tumblers 22. The end projection 32B of the locking bar serves to prevent the locking bar 32 from cocking.

Figure 8:
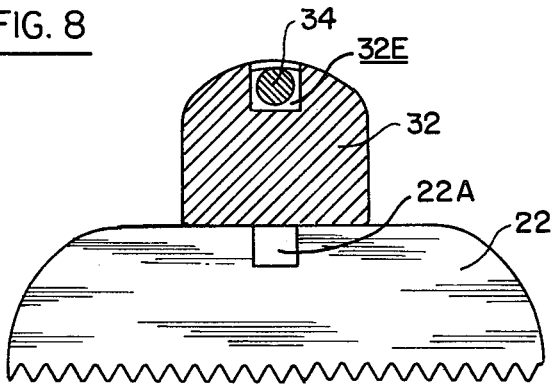

In the representations of FIGS. 7 and 8, the locking bar 32 has been shifted axially by a key #3 so that its transverse sections 32C engage slots 20A in tumblers 20 (FIG. 7) locking the tumblers against transverse movement. However, tumblers 22 are not engaged by the sections 32C (FIG. 8) and are free to move in the transverse direction. When a #1 or #2 key is inserted, the sections 32 engage slots 22A locking the tumblers 22, but do not engage slots 20A so that tumblers 20 may move transversely in either direction.

Assume first that the plug 12 is turned so that the locking bar 32 is received in a pocket a in barrel 12 in FIG. 7. In this position, resilient rod 34 biases the locking bar 32 into pocket a. Then when a key is inserted in the lock all the tumblers 20, 22 and followers 18 move back and forth in a transverse direction to particular settings determined by the code on the particular key. At this position locking bar 32 is biased into the pocket a by resilient rod 34 and does not impede the transverse movement of the tumblers and followers. However, retainer 24 holds the tumblers 20, 22 and followers 18 together. Now, if a proper #3 key is inserted, all the tumblers 20 of one lock section will line up so that their slots 20A can receive the axial sections 32C of locking bar 32, and if a #2 key is inserted all the tumblers 22 of the other lock section will line up so that their slots 22A can receive the axial sections 32C of locking bar 32 so that plug 12 can be turned in the clockwise direction by the #2 or #3 key to unlock the door.

If the wrong key is inserted the tumbler slots of the active tumblers will not line up. Then locking bar 32 will be trapped in the pocket a adjacent position A, and the plug 12 cannot be turned by the key and the door cannot be unlocked.

As stated key #1 is shorter than keys #2 and #3, and an appropriate stop is provided so that only key #1 can turn plug 12 counterclockwise to position B, where locking bar 32 is received in the pocket b adjacent to position B. At that position key #1 may be withdrawn and key #3, for example, inserted to turn the plug counterclockwise to position C. This expedient prevents either the holder of key #2 or key #3 to turn the lock to the reset position C without key #1.

When the plug is turned to position C by a #3 key, to reset the first section of the lock, portions 24A of retainer 24 are received in notches in the bore of barrel 10 adjacent to position C. This releases the retainer 24 permitting the tumblers 20 to separate from follower 18. However, section 32C of locking bar 32 holds tumblers 20 from transverse motion (FIG. 7), while other portions of locking bar 32 hold tumblers 22 from radial movement so that they remain engaged with the followers 18.

Therefore, when an original #3 key is withdrawn at the C position, and a new #3 key is inserted, all the tumblers 20 are held with their central slots 20A aligned but the followers 18 are transversely moved relative to tumblers 20 to establish new relationships in accordance with the code on the new #3 key. The inactive tumblers 22 retain their old relationship with followers 18.

When the plug is turned to position C by a #1 or #2 key, the tumblers 22 are released from followers 18, and tumblers 22 are the active tumblers. The tumblers 20 are now held in their old positions on followers 18 by locking bar 32. Therefore, a new #1 or #2 key can be inserted to reset the second section of the lock.

In either case, the plug 12 is returned to position B by the new key #2 or #3, and to position A by the #1 key. The lock is now operable only by the new key.

While a particular embodiment of the invention has been shown and described, modifications may be made. It is intended in the following claims to cover all such modifications which come within the spirit and scope of the invention.

What is claimed is:

1. A lock assembly including: a barrel; a plug rotatably mounted in said barrel; a plurality of flat follower members positioned on said plug in spaced parallel relationship along said plug and extending across said plug, each of said follower members having a serrated edge; and at least two flat tumblers, each having a serrated edge, positioned adjacent to one another on the serrated edge of each of said follower members to be individually settable to independent positions with respect to the corresponding follower member.

2. The lock assembly defined in claim 1, and which includes a retainer member positioned on said plug for retaining the tumblers and the follower members in their set positions with respect to one another.

3. The lock assembly defined in claim 2, and which includes a locking bar mounted on said plug for limited reciprocal axial movement on said plug, and a further tumbler positioned on said plug and engaging said locking bar to shift the locking bar axially to engage selectively the first tumbler of each pair and the second tumbler of each pair as determined by the particular key inserted into the lock.

4. The lock assembly defined in claim 3, in which said barrel has a pocket formed therein at a particular angular position for receiving said locking bar so as to disengage said locking bar from said tumblers to permit free transverse movement of the tumblers of said pair when a key is inserted into the lock, said retainer member engaging the bore surface of said barrel at said particular angular position to hold said tumblers and said followers engaged with one another at said first position.

5. The lock assembly defined in claim 3, in which said barrel has at least one pocket formed therein at a particular angular position for receiving said retainer member so as to disengage said tumblers from said followers, said locking bar engaging the bore surface of said barrel at said particular angular position to hold one of the flat tumblers of each pair from transverse movement when a key is inserted into the lock, and said locking bar engaging the other flat tumbler of each pair to hold the same in engagement with the corresponding follower.

* * * * *